United States Patent [19]

Epstein et al.

[11] 4,394,562

[45] Jul. 19, 1983

[54] ELECTRIC IMMERSION HEATER MOUNTING FLANGE

[75] Inventors: Fred Epstein, Clayton; Tom Holden, Mehlville, both of Mo.

[73] Assignee: Industrial Engineering and Equipment Incorporated, St. Louis, Mo.

[21] Appl. No.: 272,565

[22] Filed: Jun. 11, 1981

[51] Int. Cl.[3] ..... H05B 3/82; F24H 1/10

[52] U.S. Cl. ..... 219/306; 220/287; 220/327; 285/405; 219/318; 219/336; 219/536; 219/523

[58] Field of Search ..... 219/306, 307, 316, 318, 219/327, 328, 331, 335, 336, 523, 437, 312, 536; 174/66, 99 R, 52 R, 38; 285/363, 368, 405, 412; 220/3.8, 3.94, 3.92, 4 F, 4 R, 4 B, DIG. 25, 287, 327, 328

[56] References Cited

U.S. PATENT DOCUMENTS

| | | | |
|---|---|---|---|
| 2,613,312 | 10/1952 | Thurston | 219/318 |
| 2,763,763 | 1/1956 | Cunningham | 219/336 |
| 3,210,526 | 10/1965 | Burger | 219/318 |
| 3,265,857 | 8/1966 | Benjamin | 219/306 |

*Primary Examiner*—B. A. Reynolds
*Assistant Examiner*—Teresa J. Walberg
*Attorney, Agent, or Firm*—Cohn, Powell & Hind

[57] ABSTRACT

An electric immersion heater for use in conjunction with tanks made by different manufacturers. The tanks are typically cylindrical and include an annular mounting flange at the upper open end provided with a specific arrangement of mounting apertures receiving fasteners connecting the heater mounting flange to the tank. Tank mounting flanges of different manufacturers use different number of fasteners and this presents a problem in that, unless an adaptor of some kind is used, an immersion heater must be provided with a special flange with mounting apertures matching the tank apertures for the fasteners.

The immersion heater is provided with a mounting flange having an arrangement of mounting apertures which permits the heater to be used with tanks with mounting flanges having different mounting aperture arrangements without the necessity of adaptors or special flange arrangements.

The immersion heater is selectively mountable to a tank flange having a specific set of circular mounting apertures disposed at angular intervals on a common pitch circle diameter, or another tank flange having a different set of circular mounting apertures disposed at different angular intervals on the same pitch circle diameter. The mounting flange includes a combination of slotted mounting apertures and circular mounting apertures which are adapted to suit different arrangement of tank mounting fasteners.

6 Claims, 10 Drawing Figures

ELECTRIC IMMERSION HEATER MOUNTING FLANGE

BACKGROUND OF THE INVENTION

This invention relates generally to an electric immersion heater and particularly to an improved mounting flange for connecting the heater to a tank.

Immersion heaters of the type under consideration are used in conjunction with tanks made by different manufacturers. The tanks are typically cylindrical and include an annular mounting flange at the upper open end provided with a specific arrangement of mounting apertures receiving fasteners connecting the heater mounting flange to the tank. Some tank mounting flanges use a different number of fasteners than others and this presents a problem in that unless an adaptor of some kind is used an immersion heater must be provided with a special flange with mounting apertures matching the tank apertures.

The present immersion heater mounting flange solves this problem in a manner not revealed by the known prior art.

SUMMARY OF THE INVENTION

This immersion heater mounting flange includes an arrangement of mounting apertures which permits the heater to be used with tanks with mounting flanges having different mounting aperture arrangements.

The immersion heater is selectively mountable to a tank flange having a specific set of circular mounting apertures disposed at angular intervals on a common pitch circle diameter, or another tank flange having a different set of circular mounting apertures disposed at different angular intervals on the same pitch circle diameter. The immersion heater flange includes a plurality of mounting apertures disposed on a pitch circle corresponding to the tank pitch circle diameter at center points including a reference center point; a plurality of center points disposed at angular intervals from the reference center points equal to the angular intervals of one tank, to define a first set of center points; a plurality of center points disposed at angular intervals from the reference center point equal to the angular intervals of the apertures in the second tank, to define a second set of center points, at least the first center point of the first set of center points on each side of the reference center point, and the first center point of the second set of center points on each side of the reference center point cooperate to define elongate apertures.

In one aspect of the invention, the second center point of the first set of center points on each side of the reference center point, and the second center point of the second set of center points on each side of the reference center point, cooperate to define elongate apertures.

In another aspect of the invention, the first set of center points are disposed at forty five degrees (45°) from the reference center point, and the second set of center points are disposed at forty degrees (40°) from the reference center point.

In still another aspect of the invention, an angular gasket is provided having the same aperture arrangement as the heater mounting flange.

DESCRIPTION OF THE PREFERRED EMBODIMENT

Figure 1:
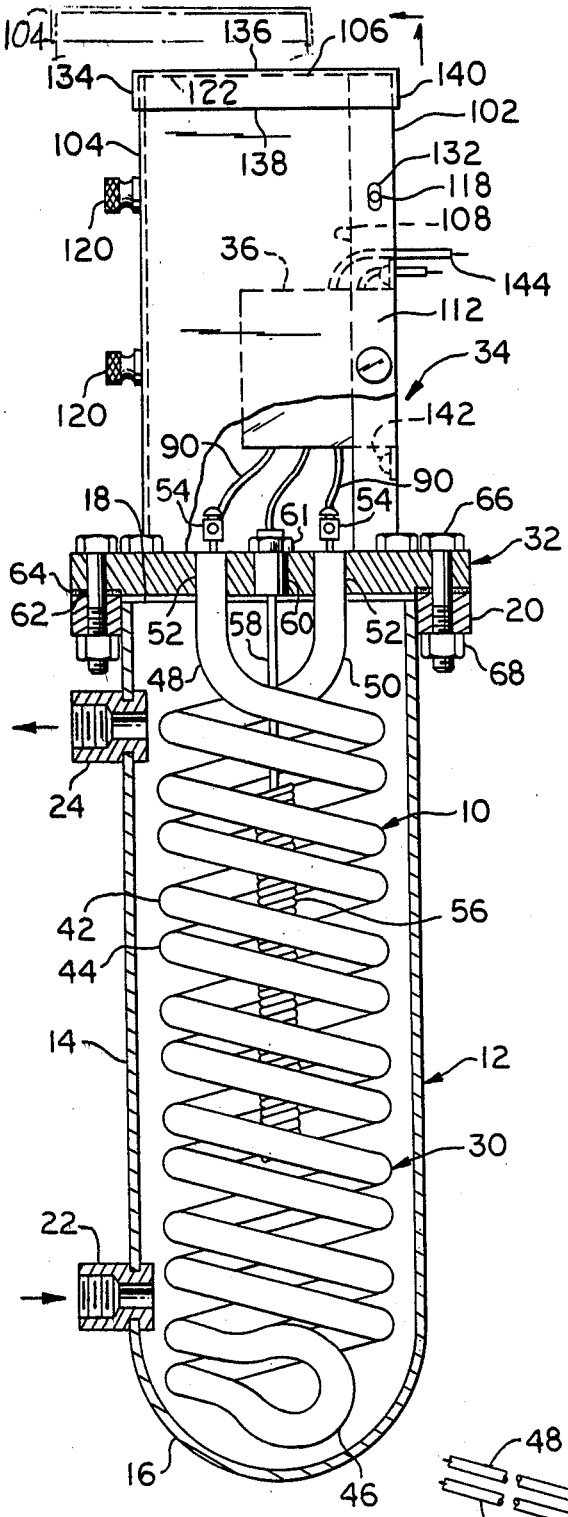
FIG. 1 is a longitudinal sectional view of the electric immersion heater and tank assembly.
Figure 2:
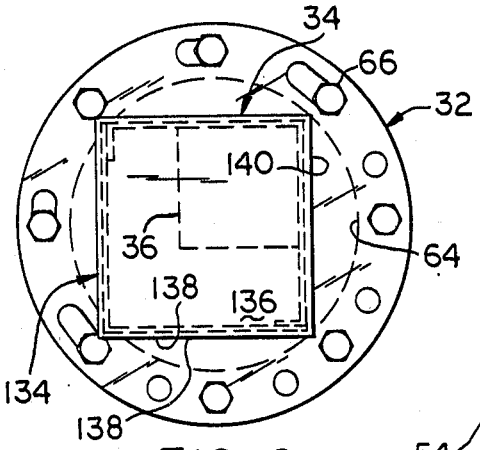
FIG. 2 is a plan view of the immersion heater.

Referring now by reference numerals to the drawings and first to FIGS. 1 and 2 it will be understood that the immersion heater and tank assembly shown includes an electrical immersion heater generally indicated by numeral 10 which is received within a tank 12 of the type used for heating fuel oil.

Figure 3:
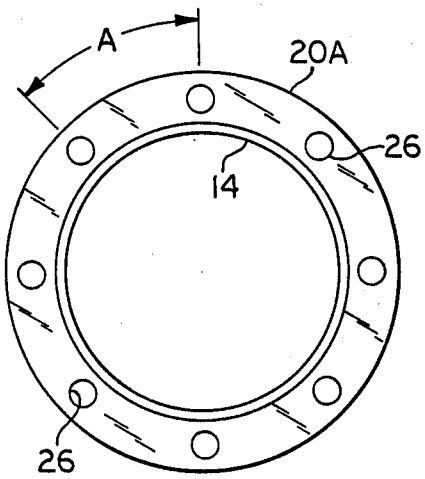
FIG. 3 is a simplified plan view of a tank flange showing the mounting aperture arrangement.
Figure 4:
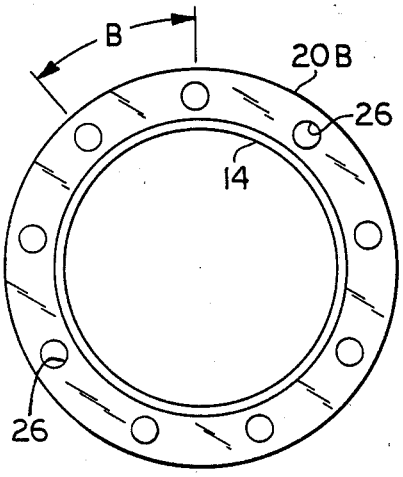
FIG. 4 is a similar view to FIG. 3 showing a modified tank flange with a different mounting aperture arrangement.

As shown in FIG. 1 the tank 12 includes a generally cylindrical body 14 closed at the lower end 16 and having an opening 18 at the upper end. The opening 18 is provided with an annular flange 20 welded, or otherwise attached thereto. Inlet and outlet ports 22 and 24, respectively, provide a means of circulating fuel oil, which is to be heated, through the tank 12. As shown in FIGS. 1, 3 and 4 the annular mounting flange 20A or 20B is provided with a plurality of circular mounting apertures 26 disposed on a common pitch circle diameter at angular intervals equal to three hundred sixty degrees (360°) divided by the number of apertures. In one model of the tank 12 shown in FIG. 3 the angular interval of the apertures in the tank flange 20A is equal to A. In another model, shown in FIG. 4 there is at least one additional aperture and the angular interval of the apertures in the tank flange 20B is equal to B. For example, in the model shown in FIG. 3, eight (8) apertures 26 are provided so that A is equal to forty-five degrees (45°). In the other model, shown in FIG. 4, nine (9) apertures 26 are provided so that B is equal to forty degrees (40°).

As shown in FIG. 1, the immersion heater 10 includes a heating element 30, a mounting flange 32, and a terminal box 34 for a heater control assembly generally indicated by numeral 36 and for the terminals of the heating element 30.

Figure 5:
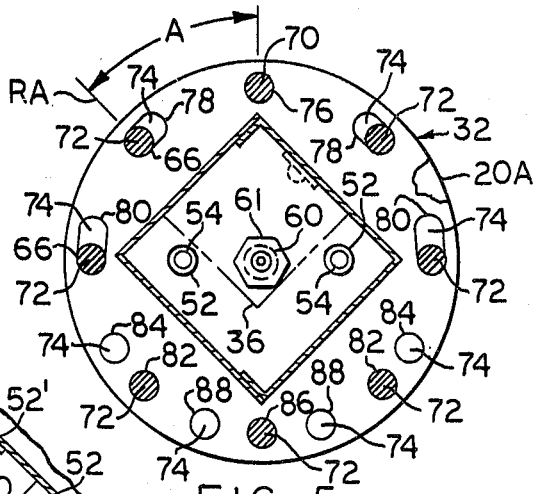
FIG. 5 is a plan view of the immersion heater mounting flange showing use with a tank flange of the type shown in FIG. 3.

The heating element 30 is in the embodiment shown formed from a metallic sheath encasing a resistance wire embedded in compressed granular material such as magnesium oxide. Following compression, the heating element 30 is annealed and is then double wound to provide a first portion 42 having a plurality of spiral coils, and a second portion 44 having a plurality of spiral coils interspaced between the spaced coils of the first portion. The coil diameter of the first and second portions 42 and 44 is the same, and said first and second portions are connected by a common end loop 46. As shown in FIGS. 1 and 5, the upper terminal ends of the elements 42 and 44 indicated by numerals 48 and 50, respectively, are received within apertures 52 provided in the mounting flange 32 and attached thereto, as by welding. In the preferred embodiment, as shown in FIG. 1, a thermostat bulb 56 is provided disposed coaxially interiorly of the coils of the heater element 30, said bulb having a straight upper portion 58 received within a central aperture 60 provided in the mounting flange 32 and attached thereto as by a capillary fitting 61.

Figure 9:
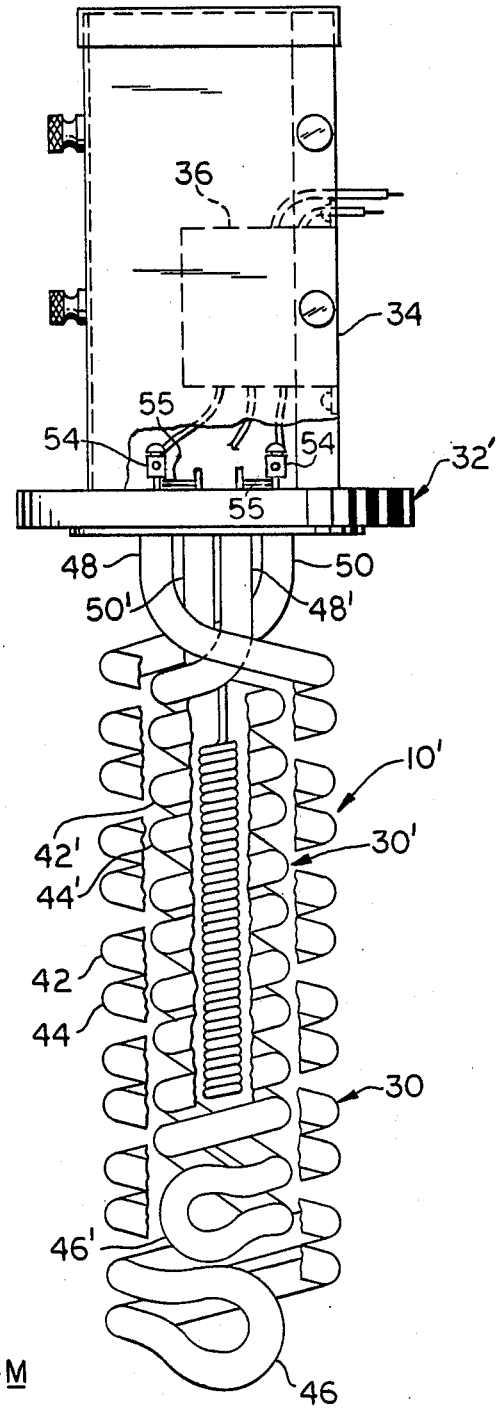
FIG. 9 is a longitudinal sectional view of a modified immersion heater.
Figure 10:
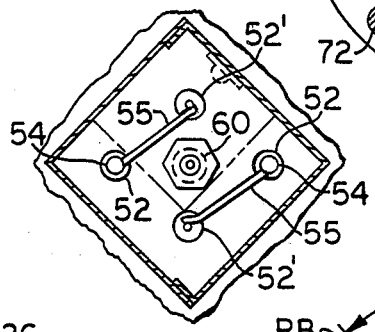
FIG. 10 is a fragmentary plan view of the heating element connections for the modified immersion heater.

FIG. 9 discloses a modified immersion heater 10′ which is provided with a second heating element 30′ coaxially disposed inner heating element. In other respects, except for additional heating element connections on the flange 32′ the parts of the immersion heater are identical to those shown in FIG. 1 and have been assigned identical reference characters where indicated. The second heater element, indicated by numeral 30′ is also double wound to provide a first portion 42′ and a second portion 44′ having a plurality of spiral coils interspaced between the spaced coils of said first portion. The first and second portions 42′ and 44′ have the same coil diameter, which is a smaller coil diameter than that of the first and second portions 42 and 44 of said outer coil, and said portions 42′ and 44′ are connected by a common end loop 46′. As shown in FIGS. 2 and 10, the upper terminal ends of said portions 44′, indicated by numerals 48′ and 50′, respectively, are received within apertures 52′ provided in the mounting flange 32′ and attached thereto as by welding, as described above with respect to heating element 30. The end portions 48′ and 50′ are connected to each other as by soldering conductor strips 55 between said ends.

Figure 8:
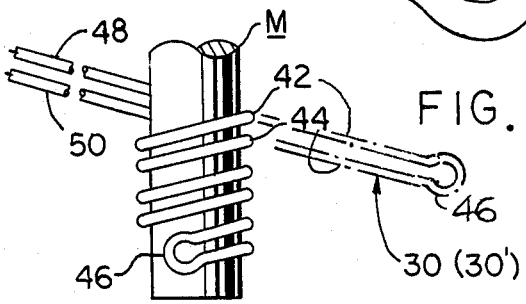
FIG. 8 is a schematic view showing a method of forming the spiral wound heater elements.

As shown generally in FIG. 8, using heater element 30 as an example, in the preferred embodiment the double wound coils 30 and 30′ are formed by bending an elongate heater element, shown in phantom outline, into a U-shaped configuration to provide portions 42 and 44 and the looped end 46 and then spiral wrapping the side-by-side portions 42 and 44 around a cylindrical mandrel indicated by M to provide a heating element terminating in free outer ends 48 and 50. In the case of heater element 30′ as will be readily understood, a smaller diameter mandrel is used.

Figure 7:
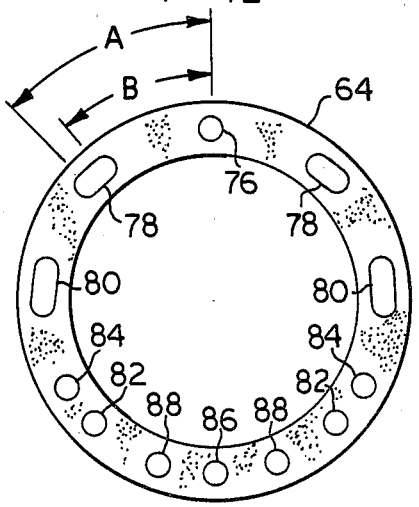
FIG. 7 is a plan view of a common gasket.

As shown in FIGS. 1 and 7 the mounting flange 32 includes an annular recessed portion 62 provided with an annular gasket 64 of suitable sealing material such as asbestos. The mounting flange 32 and the gasket 64 are adapted to be connected to a tank flange 20 having circular apertures 26 at angular intervals of A, or to a tank flange 20B having circular apertures 26 at angular intervals of B by bolts 66 and nuts 68. To this end, the mounting flange 32 and the gasket 64 include both elongate, slotted apertures and circular apertures as will now be described.

Figure 6:
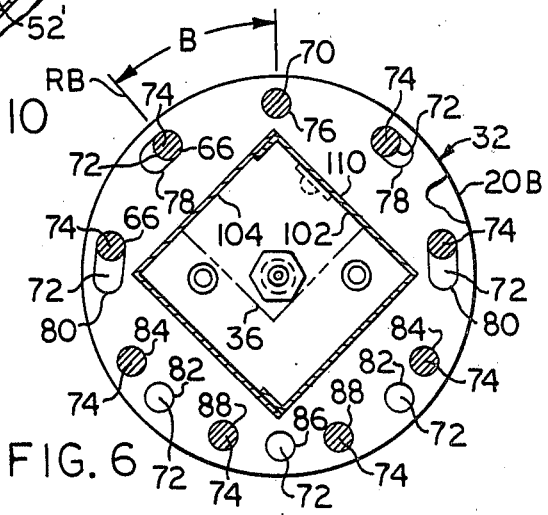
FIG. 6 is a plan view of the immersion heater mounting flange showing use with a tank flange of the type shown in FIG. 4.

The adaptability of the mounting flanges 32 to connect to the tank flange 20A or the tank flange 20B is best shown by reference to FIGS. 5 and 6. In the example shown in FIG. 5, the mounting flange 32 is connected by bolts 66 to a tank flange 20A having eight (8) circular apertures at forty-five degrees (45°). In the example shown in FIG. 6, the mounting flange 32 is connected to a tank flange 20B having nine (9) circular apertures at forty degrees (40°). As shown in FIG. 7, the gasket 64 is provided with matching elongate slotted apertures and circular apertures which are disposed in register with the apertures in the mounting flange 32.

As shown in FIGS. 5 and 6, the mounting flange circular and elongate apertures are defined by a reference center point 70, a first set of center points 72 and a second set of center points 74, said center points being defined by the intersection of radial lines typified by RA and RB disposed at the designate incremental angles A or B, with the pitch circle. FIGS. 5 and 6 are identical except that in FIG. 6, one more connection bolt 66 is used to connect tank flange 20B than is used to connect tank flange 20A in FIG. 5.

As shown in FIGS. 5 and 6, the first set of center points 72 provides a plurality of such points disposed on a pitch circle diameter corresponding to the tank pitch circle diameter at centers measured from the reference center 70 at angular increments A equal to three-hundred-sixty degrees (360°) divided by the number of mounting apertures 26 in tank flange 20B, said number of mounting apertures being one greater than the number of mounting apertures shown in tank flange A.

As shown in FIGS. 3 and 5 the number of tank apertures 26 is eight (8) which results in a first set of center points 72 disposed at forty-five degrees (45°) intervals. As shown in FIGS. 4 and 6, the number of tank apertures 26 is nine (9) which results in a second set of center points 74 disposed at forty degree (40°) intervals.

As shown in both FIGS. 5 and 6 reference center point 70 defines a circular mounting aperture 76. Center points 72 and 74, disposed at forty-five degrees (45°) and forty degrees (40°) respectively from the reference center point 70, define slotted apertures 78. Center points 72 and 74, disposed at ninety degrees (90°) and eight degrees (80°) respectively from the reference center point 70, define slotted apertures 80. Center points 72 and 74 disposed at one hundred and thirty five degrees (135°) and one hundred and twenty degrees (120°) respectively from the reference center point 70 define circular mounting apertures 82 and 84 respectively. Center points 72 and 74, disposed at one hundred and eight degrees (180°) and one hundred and sixty degrees (160°) respectively from the reference center point 70, define circular mounting apertures 86 and 88 respectively. As will be readily understood from FIGS. 5, 6 and 7, the apertures on one side (clockwise) of the reference center point 70 are in mirror image of those on the other side (counterclockwise).

As shown in FIG. 1, the heating element and portions 48 and 50 are connected to the heater control assembly 36 in a conventional manner as by conductors 90 and 92 by way of pressure connectors 54. The thermostat bulb upper end portion 58, which passes through the capillary fitting 61, is also connected to control assembly 36.

The control assembly 36, as shown in FIG. 1 is attached to the terminal box 34 as by fasteners 142 and the terminal box itself is operatively connected to the mounting flange 32.

As best shown by reference to FIGS. 1, 2 and 6, the terminal box 34 is formed into base and cover portions 102 and 104, each of said two portions 102 and 104 being generally ell-shaped. The base portion 102, includes upper margins 106, right angularly formed side margins 108 having drilled and tapped holes 118, and lower margins 110 attached to the mounting flange 32 as by welding. The cover portion 104 includes upper margins 122 and side margins 124, said side margins being provided with oversized apertures 132 aligned with said tapped holes 118. The cover portion 104 is removably connected to the base portion 102 as by four machine screws 120. A generally square top 134 having a top panel 136 and adjacent depending side margins 138 and 140 forms the upper part of the cover 104, and is attached as by welding side margins 138 to the cover upper margins 122. The margins 140 are free and also overlappingly related to the upper margins 106 of the first portion 102. This arrangement of parts permits the removal of the terminal box cover portion 104 by simply removing the screws 120 and raising the cover portion 104 until the top 134 clears the base portion 102 as shown in FIG. 1 in phantom outline. This exposes the heater control assembly 36 for repair or any other reasons.

The installation of the immersion heater 10 within the tank 12 is simply a matter of placing the adaptor flange 32, in register with the gasket 64 and aligning the reference aperture 70 with one of the apertures 26 of the particular tank flange apertures 20A and 20B as the case may be, and connecting said flanges with the appropriate number of bolts 66 so that the adaptor flanges 32 provides a closure for the tank opening 18. When the heater 10 is mounted to the tank 12 adjustments to the heater control assembly 36 can be made and the terminal box closed by connecting the removable cover portion 104 to the fixed base portion 102. Because the heating element interspaced coil portions 42 and 44 providing outgoing and return coils of the same diameter, the available surface area of the heating element is increased, and in addition the spacing between the coil portions permits more efficient flow of heating oil over the heating surface area.

We claim as our invention:

1. An immersion heater and tank assembly comprising:

(a) a tank including an open end having an annular flange, said flange having a plurality of circular mounting apertures disposed on a common pitch circle diameter at angular intervals equal to three hundred and sixty degrees (360°) divided by the number of apertures in the tank flange, (b) an immersion heater receivable within the tank and having an annular mounting flange, said flange having mounting apertures disposed on a pitch circle diameter corresponding to the tank pitch circle diameter at center points including:

1. a reference center point,
2. a plurality of center points disposed at angular intervals from the reference center point equal to three hundred and sixty degrees (360°) divided by the number of apertures in the tank flange to define a first set of center points,
3. a plurality of center points disposed at angular intervals from the reference center point equal to three hundred and sixty degrees (360°) divided by the number of apertures in the tank flange plus one, to define a second set of center points, and
4. at least the first center point of the first set of center points on each side of the reference center point and the first center point of the second set of center points on each side of the reference center point cooperate to define elongate apertures, and (c) fastener means receivable by the mounting apertures of the tank flange and the heater flange to connect the heater to the tank.

2. An assembly as defined in claim 1, in which:

(d) the second center point of the first set of center points on each side of the reference center point and the second center point of the second set of center points on each side of the reference center point define elongate apertures.

3. An assembly as defined in claim 2, in which:

(e) the reference center point defines a circular aperture.

4. An assembly as defined in claim 1, in which:

(d) the first set of center points are disposed at forty five degrees (45°) from the reference center point and second set of center points are disposed at forty degrees (40°) from the reference center point.

5. An immersion heater selectively mountable to a first tank opening flange having a specific number of circular mounting apertures disposed on a common pitch circle diameter at equal angular intervals, or a second tank opening flange having a different number of circular mounting apertures disposed on the same pitch circle diameter at equal angular intervals, the immersion heater comprising:

(a) a heating element receivable within the tank, (b) an adaptor flange operatively connected to the heating element and selectively connectible to one of said tank flanges, said adaptor flange including a plurality of apertures disposed on a pitch circle diameter corresponding to the tank pitch circle diameter at center points including:

1. a reference center point,
2. a first set of center points disposed at angular intervals from the reference center point equal to the angular intervals of the apertures of the first tank,
3. a second set of center points disposed at angular intervals from the reference point equal to the angular intervals of the apertures of the second tank, and
4. at least the first center point of the first set of center points on each side of the reference center point, and the first center point of the second set of center points on each side of the reference center point, cooperate to define elongate apertures, and (c) fastener means receivable by the mounting apertures of the tank flange and the heater flange to connect the heater to the tank.

6. An immersion heater as defined in claim 5, in which:

(d) the first set of center points are disposed at forty five degree (45°) intervals and the second set of center points are disposed at forty degree (40°) intervals, (e) the center points at forty five degrees (45°) clockwise and counterclockwise of the reference center point, and the center points at forty degrees (40°) clockwise and counterclockwise of the reference center point cooperate to define elongate apertures, (f) the center points at ninety degrees (90°) clockwise and counterclockwise of the reference center point and the center points at eighty degrees (80°) clockwise and counterclockwise of the reference center point cooperate to define elongate apertures, and (g) the remaining center points define circular apertures.

* * * * *